United States Patent [19]

Owens

[11] 4,154,214

[45] May 15, 1979

[54] FIREPLACE HEAT EXCHANGE APPARATUS

[76] Inventor: Furman B. Owens, 11 Timrod Way, Greenville, S.C. 29607

[21] Appl. No.: 811,528

[22] Filed: Jun. 30, 1977

[51] Int. Cl.[2] ..... F24B 7/00

[52] U.S. Cl. ..... 126/121; 126/164

[58] Field of Search ..... 126/121, 120, 129, 131, 126/128, 153 R, 164, 165; 237/51

[56] References Cited

U.S. PATENT DOCUMENTS

| | | | |
|---|---|---|---|
| 1,562,139 | 11/1925 | Berry | 126/121 |
| 2,725,874 | 12/1955 | Payne | 126/121 |
| 4,008,706 | 2/1977 | Buanno | 126/121 |
| 4,010,729 | 3/1977 | Egli | 126/121 |
| 4,050,441 | 9/1977 | Horwinski | 126/121 |
| 4,076,012 | 2/1978 | Meeker | 126/121 X |

*Primary Examiner*—Dennis L. Taylor

*Attorney, Agent, or Firm*—Bailey, Dority & Flint

[57] ABSTRACT

A fireplace heat exchange apparatus includes a bottom plate and a top plate spaced above the bottom plate providing a hearth for the fireplace. A front wall stands between the top and bottom plate having an air inlet manifold laterally spaced at one end thereof and an air outlet located adjacent the other end thereof. A plurality of spaced curved vane members extend between the inlet and outlet manifolds to provide a plurality of curved air distribution passageways through which air flows in heat exchange relationship with the vane elements.

5 Claims, 3 Drawing Figures

Fig. 1.
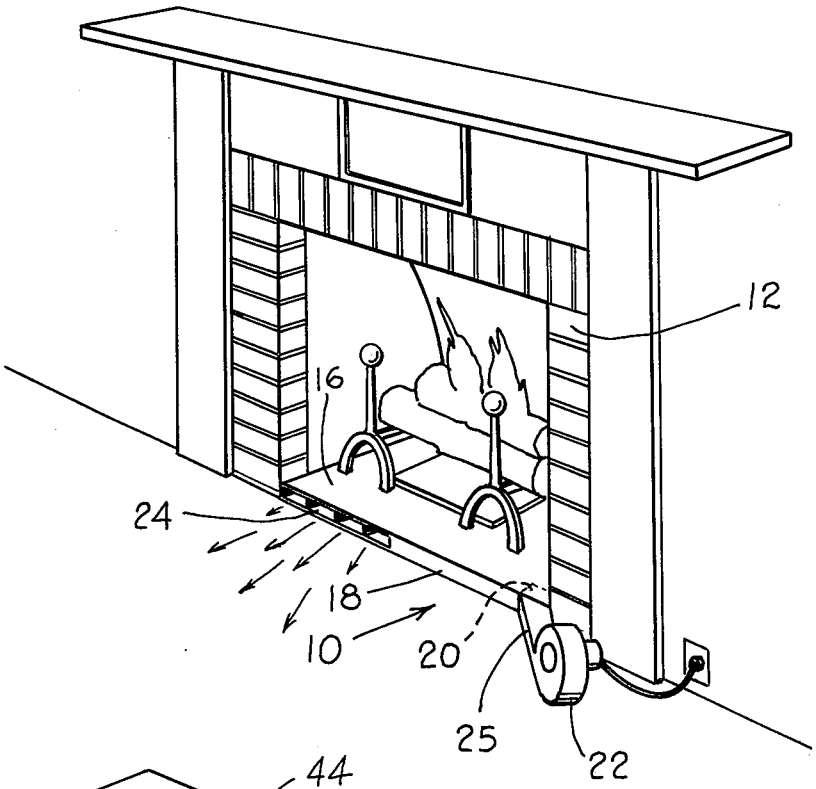
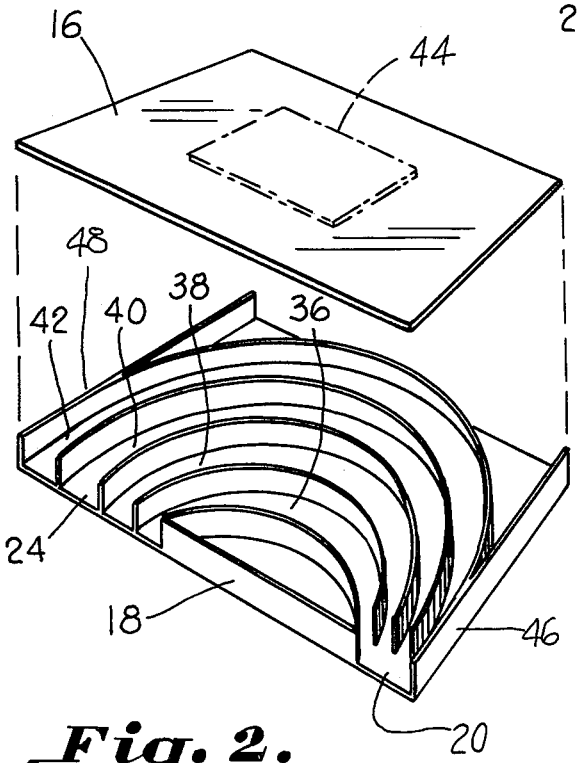
Fig. 2.
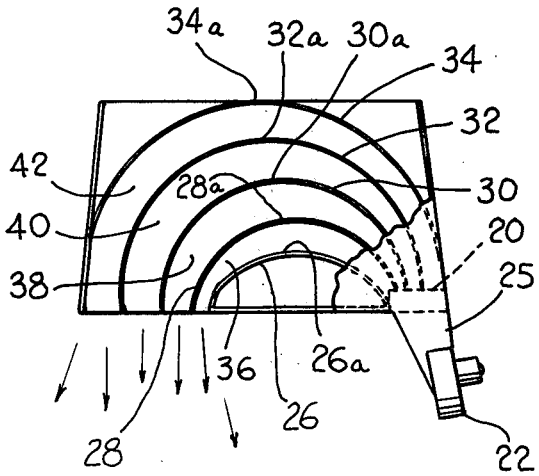
Fig. 3.

FIREPLACE HEAT EXCHANGE APPARATUS

BACKGROUND OF THE INVENTION

Many prior devices have been developed for capturing the heat given off of a wood or coal burning fireplace so that heat is not lost out the chimney. One device is disclosed in U. S. Pat. No. 3,995,611 wherein a fireplace heating channel is provided which may be fitted in a conventional type fireplace increasing the heating efficiency thereof. However, this device seeks to capture the heat from the sides and above the fire burning in the fireplace and neglects the maximum concentration of heat which is in the hot coals which fall upon the hearth. U.S. Pat. No. 1,469,494 seeks to provide a hollow hearth wherein air is circulated so as to transfer heat from the coals falling upon the hearth. However, the provision of a metal surface for the hearth has been a problem in that the plate is highly subject to warping due to the uneven heat concentration on the metal plate and the inability to rapidly and efficiently transfer the heat away and maintain an even heat distribution over the plate.

Accordingly, an important object of the present invention is to provide a fireplace heat exchange apparatus which provides heat recovery from a fireplace in an area of maximum heat concentration.

Still another important object of the present invention is to provide a heat exchange apparatus for use in a conventional fireplace wherein air circulates underneath an artificial hearth surface having a plurality of heat transfer elements which effect a rapid and even heat transfer from the hearth.

Still another important object of the present invention is to provide heat transfer elements below an artificial hearth surface which efficiently transfer the heat from the hearth and provide passageways which initiate a circular air distribution pattern into the space to be heated.

SUMMARY OF THE INVENTION

It has been found that apparatus for efficiently recovering heat from a convetnional type fireplace can be provided by a bottom plate and a top plate spaced above the bottom plate which provides a surface for a fireplace hearth. A front wall extends between the top and bottom plate having an air inlet manifold located at one end thereof for receiving air and an air outlet located adjacent the other end for discharging the air. A plurality of spaced curved vane members extend from the inlet to the outlet between the top and bottom plates defining air distribution passageways therebetween through which air flows for heat exchange with the vane elements.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a perspective view illustrating a fireplace fitted with a fireplace heat exchange apparatus constructed in accordance with the present invention;

FIG. 2 is a perspective view of the heat exchange apparatus of FIG. 1 with the top plate removed; and FIG. 3 is a top plan view of a heat exchange apparatus constructed in accordance with the present invention.

DESCRIPTION OF A PREFERRED EMBODIMENT

The apparatus of the present invention is simple in construction and yet affords maximum heat recovery from a fireplace and may be utilized in any existing conventional fireplace or the invention may be incorporated into a fireplace structure being newly built. The apparatus is generally freestanding and requires no attachment and is readily insertable in a conventional fireplace requiring no modification to the fireplace structure.

Referring now in more detail to the drawing, the fireplace heat exchange apparatus is illustrated generally at 10 as being inserted into the opening of a fireplace 12. The apparatus includes a bottom plate 14 and a top plate 16 which provides the hearth of the fireplace when inserted therein. A front wall 18 adjoins the front edges of the bottom plate 14 and top plate 16 and may be made as one piece or integral therewith in any suitable manner such as by welding.

An air inlet manifold 20 is provided at one end of the front wall 18 for receiving air from a blower means 22 and an air outlet manifold 24 is located at the remote end of the front wall 18 laterally spaced from the inlet 20. The air inlet manifold 20 is made so that a suitable duct connection 25 may be received therein connecting the pressure side of the blower 22 and the air inlet 20 for delivering a direct and unrestricted flow of air to the heat exchange apparatus.

A plurality of curved vane members 26, 28, 30, 32, and 34 extend in a curved manner from the air inlet manifold 20 to the air outlet 24 and also extend between the bottom and top plates 14 and 16, respectively. It is noted that the vane members diverge relative to each other as they are curved from the air inlet to the outlet. In this manner, the vane members define divergent air distribution passageways 36, 38, 40, and 42 therebetween through which air flows for heat exchange relationship with the vane elements. Each member includes an apex portion **26*a*–34*a*, respectively, which corresponds to the farthest point outwards along the curved path to which the air travels before turning to leave the heat exchanger. Advantageously, the apex portions lie centered in a zone of maximum heat concentration relative to the generally central location of fuel burning adjacently above the hearth plate 16. The hearth plate 16** provides a concentrated area of radiating heat from the hot coals falling thereon into the vane areas of the invention. The configuration of the vanes allows a high flow volume of air to be used in transferring this normally wasted heat source into the interior space to be heated.

It is believed that the divergent air passageways produce an expanded air flow wherein conditions exist for maximum transfer of heat with the vane elements and heated hearth plate 16. The flow of air proceeds smoothly between the curved walls of the vane elements and the curved configuration provides an increased heat transfer surface along the air passageways below the hearth plate 16. In this manner increased and even heat transfer is made from the hearth plate which reduces the tendency of the plate to warp. The curved path of the air flow through the passageways provides the initiation of circular air patterns in the area to be heated which provides for a more even and extensive heating of the area.

In one fireplace application one embodiment of the heat exchange apparatus 10 was constructed wherein the top and bottom plates were approximately thirty-seven inches wide and tapered slightly toward the rear with the plates having a depth of approximately twenty-one inches. The height of the vane elements, the front wall 18, and the side walls 46 and 48 of the apparatus were approximately 0.875 inch. The opening for the air inlet duct was approximately 4¼ inches wide and the opening for the air outlet was approximately 10½ inches wide. The various plates as well as the vane elements are preferably rolled steel having a ⅛ inch thickness. The blower 22 utilized was rated at 70 cubic feet per minute. The respective lengths of the vane elements 28–34 were 36.125, 43.0625, 52.5, and 64.75 inches. The entire structure is made integral in any suitable manner such as welding.

To reduce the possibility of warpage to hearth plate 16 an auxiliary top plate shown in dashed lines 44 may be utilized unattached on the top of plate 16 under the falling coals. Such may be needed particularly when air is not being circulated beneath the hearth plate which normally serves to maintain an even heat distribution over the plate.

While a preferred embodiment of the invention has been described using specific terms, such description is for illustrative purposes only and it is to be understood that changes and variations may be made without departing from the spirit or scope of the following claims.

What is claimed is:

1. Heat exchange apparatus for recovering heat and increasing the efficiency of a fireplace comprising:

a bottom plate;

a top plate spaced above said bottom plate providing a hearth for the fireplace;

a front wall extending between said top and bottom plate;

an air inlet manifold located at one end of said front plate for receiving air;

an air outlet located adjacent the other end for discharging air;

a plurality of spaced curved vane members extending from said air inlet to said air outlet and between said top and bottom plates arranged in a generally side-by-side manner, each said vane member being open concavely toward said front wall; and said vane members defining a plurality of continuous curved air distribution passageways therebetween through which air flows from said air inlet to said air inlet facilitating heat exchange with said vane elements and increased room circulation.

2. The apparatus of claim 1 wherein each said vane member inclues an apex portion which lies in a zone of maximum heat concentration relative to the generally central location of fuel burning adjacent said top plate.

3. The apparatus of claim 1 wherein said vane members diverge from said inlet to said outlet defining divergent air passageways producing an expanded air flow for increased heat transfer.

4. The apparatus of claim 1 including sidewalls adjoining said top and bottom plates.

5. The apparatus of claim 1 including a blower means and duct means connecting said blower means to said air inlet manifold for direct unrestricted delivery of air.

* * * * *